US006712297B1

(12) United States Patent
Sugiyama et al.

(10) Patent No.: US 6,712,297 B1
(45) Date of Patent: Mar. 30, 2004

(54) ELECTROMAGNETIC FUEL INJECTION DEVICE FOR INTERNAL COMBUSTION ENGINE

(75) Inventors: Koichi Sugiyama, Nagoya (JP); Masaru Nekita, Toyoake (JP); Yoshinori Yamashita, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/285,581

(22) Filed: Nov. 1, 2002

(30) Foreign Application Priority Data

Sep. 18, 2002 (JP) ..... 2002-271626

(51) Int. Cl.[7] ..... B05B 1/30

(52) U.S. Cl. ..... 239/585.2; 239/585.1; 239/533.2; 251/129.16

(58) Field of Search ..... 239/533.2, 585.1–585.5, 239/533.1; 251/129.16, 129.18, 129.2

(56) References Cited

U.S. PATENT DOCUMENTS 4,509,693 A * 4/1985 Nakai ..... 239/585.1
6,409,101 B1 * 6/2002 D'Arrigo ..... 239/585.1
6,616,073 B2 * 9/2003 Sugiyama ..... 239/585.1

FOREIGN PATENT DOCUMENTS

JP 11-148437 6/1999
JP 2002-48031 2/2002

* cited by examiner

*Primary Examiner*—Dinh Q. Nguyen
(74) *Attorney, Agent, or Firm*—Nixon & Vanderhye P.C.

(57) ABSTRACT

An injection device satisfies the following conditions: 5 mm≦La≦10 mm, 0 mm≦Lb≦1.0 mm, Lb≦Lc, and 0.5≦Ld/La ≦1.5, wherein La is a length of a coil, Lb is a distance between a downstream end surface of the coil and a downstream end surface of a non-magnetic portion, Lc is a distance between the end surface of the coil and a downstream end surface of a stationary core (or stationary portion), Ld is a length of the non-magnetic portion. The device also satisfies the following conditions: 0.2≦Sb/Sa≦0.9, and 0.1≦(Lf+Lc)/La≦1.0, wherein Sa is a cross-sectional area of a main portion, Sb is a cross-sectional area of a reduced size portion, Lf is a length of the reduced size portion.

6 Claims, 14 Drawing Sheets

ELECTROMAGNETIC FUEL INJECTION DEVICE FOR INTERNAL COMBUSTION ENGINE

CROSS REFERENCE TO RELATED APPLICATION

This application is based on and incorporates herein by reference Japanese Patent Application No. 2000-229906 (corresponding to Japanese Unexamined Patent Publication No. 2002-48031) filed on Jul. 28, 2000 and Japanese Patent Application No. 2002-271626 filed on Sep. 18, 2002.

BACKGROUND OF THE INVENTION

1. Field of the Invention

The present invention relates to an electromagnetic fuel injection device of an internal combustion engine (hereinafter simply referred to as an engine).

2. Description of Related Art

In an electromagnetic fuel injection device, it is desirable to control a fuel injection amount in such a manner that the fuel injection amount is proportioned to a length of a corresponding pulse signal applied, for example, from an engine control unit to a coil (or coil winding). To achieve this, fuel injection characteristics of the fuel injection device need to be approximated to a waveform of the pulse signal applied to the coil. That is, a valve opening period of the fuel injection device at time of energization of the coil needs to be reduced, and a valve closing period of the fuel injection device at time of deenergization of the coil needs to be reduced.

When a magnetic attractive force for attracting a movable core, which reciprocates together with a valve member, toward a stationary core is increased, a valve opening speed is increased to reduce the valve opening period. However, when a number of turns of the coil is increased to increase the magnetic attractive force, a size of the fuel injection device is disadvantageously increased.

Furthermore, when a load of a spring, which urges the valve member toward a valve opening direction, is increased, a valve closing speed is also increased to decrease the valve closing period. However, when the spring load is increased, a valve opening speed of the movable core, which is attracted toward the stationary core against the spring load, and thus of the valve member is disadvantageously reduced.

To address the above disadvantages, in a fuel injection device disclosed in Japanese unexamined patent publication No. 11-148437, positions of a movable core, a stationary core and a coil are adjusted to increase a magnetic attractive force, thereby increasing a valve opening speed to reduce a valve opening period without increasing a number of turns of the coil and without increasing a size of a fuel injection valve.

However, when the magnetic attractive force is increased, a time period required for reducing the magnetic attractive force at time of deenergization of the coil is increased. That is, a valve closing period is increased. As described above, an increase in a spring load causes an increase in a valve closing speed to reduce a valve closing period. However, as described above, when the spring load is increased, the magnetic attractive force for attracting the movable core against the spring load needs to be increased. A portion of the magnetic attractive force, which is increased by adjusting positions of the movable core, the stationary core and the coil, is used to compensate an increase in the spring load, so that it is difficult to increase a valve opening speed.

When the valve opening period or the valve closing period is increased, characteristics of the fuel injection rate become non-proportional to the drive signal applied to the coil (e.g., the signal width of the pulse signal), resulting in variations in the fuel injection amount. Thus, it is difficult to control the fuel injection amount. Particularly, when the signal width of the drive signal applied to the coil is relatively small, for example, during idle operation of the engine, it is difficult to control the fuel injection amount. Thus, in order to provide a required fuel injection amount, the signal width of the corresponding drive signal is increased to inject an excessive amount of fuel. As a result, a fuel consumption is increased, and an amount of noxious components in the exhaust gases increase.

SUMMARY OF THE INVENTION

The present invention addresses the above disadvantages. Thus, it is an objective of the present invention to provide a compact fuel injection device, which achieves a reduced valve opening period and a reduced valve closing period to more precisely control a fuel injection amount.

To address the objective of the present invention, there is provided a fuel injection device including a cylindrical member, a valve body, a valve member, a movable core, a stationary core, an urging means and a coil. The cylindrical member includes a first magnetic portion, a magnetic shield portion and a second magnetic portion arranged in this order from a downstream end of the cylindrical member toward an upstream end of the cylindrical member. The valve body is held by the first magnetic portion of the cylindrical member and includes at least one fuel injection hole and a vale seat arranged on an upstream side of the injection hole. The valve member is reciprocably received in the cylindrical member and includes an abutting portion. The abutting portion is seatable on the valve seat to close the injection hole and is also liftable from the valve seat to release the injection hole. The movable core is arranged on an upstream side of the valve member and is reciprocable together with the valve member. The stationary core is arranged on an upstream side of the movable core and is opposed to the movable core in the cylindrical member. The urging means is for urging the valve member against the valve seat. The coil is arranged radially outward of the cylindrical member to generate a magnetic force for attracting the movable core toward the stationary core upon energization of the coil. The cylindrical member, the stationary core and the coil are sized to satisfy the following conditions: $5\ \text{mm} \leqq La \leqq 10\ \text{mm}$, $0\ \text{mm} \leqq Lb \leqq 1.0\ \text{mm}$, $Lb < Lc$, and $0.5 \leqq Ld/La \leqq 1.5$, wherein La is the axial length of the coil, Lb is the axial distance between a downstream end surface of the coil and a downstream end surface of the magnetic shield portion, Lc is the axial distance between the downstream end surface of the coil and a downstream end surface of the stationary core, and Ld is the axial length of the magnetic shield portion.

To achieve the objective of the present invention, there is also provided a fuel injection device including a body, a cylindrical stationary portion, a valve member, a movable portion, an urging means and a coil. The body includes at least one fuel injection hole and a valve seat arranged on an upstream side of the injection hole. The cylindrical stationary portion exhibits magnetism and is secured to the body. The stationary portion includes a main portion and a reduced size portion, which are arranged in an axial direction of the stationary portion. A cross-sectional area of the reduced size portion measured in a plane perpendicular to an axis of the stationary portion is smaller than a cross sectional area of the main portion measured in a plane perpendicular to the axis of the stationary portion. The valve member is reciprocably received in the body and includes an abutting portion. The abutting portion is seatable on the valve seat to close the injection hole and is also liftable from the valve seat to release the injection hole. The movable portion is arranged on a downstream side of the stationary portion and also on an upstream side of the valve member and is reciprocable together with the valve member. The urging means is for urging the valve member against the valve seat. The coil is coaxial with the stationary portion and is arranged radially outward of the stationary portion to generate a magnetic force for attracting the movable portion toward the stationary portion upon energization of the coil. The stationary portion is sized to satisfy the following condition: $0.2 \leqq Sb/Sa \leqq 0.9$, wherein Sa is the cross-sectional area of the main portion, and Sb is the cross-sectional area of the reduced size portion. The stationary portion and the coil are sized to satisfy the following condition: $0.1 \leqq (Lf+Lc)/La \leqq 1.0$, wherein La is the axial length of the coil, Lf is the axial length of the reduced size portion, and Lc is the axial distance between a downstream end surface of the coil and a downstream end surface of the stationary portion.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

First Embodiment

A fuel injection device according to a first embodiment of the present invention will be described with reference to FIGS. 1 to 5.

Figure 1:
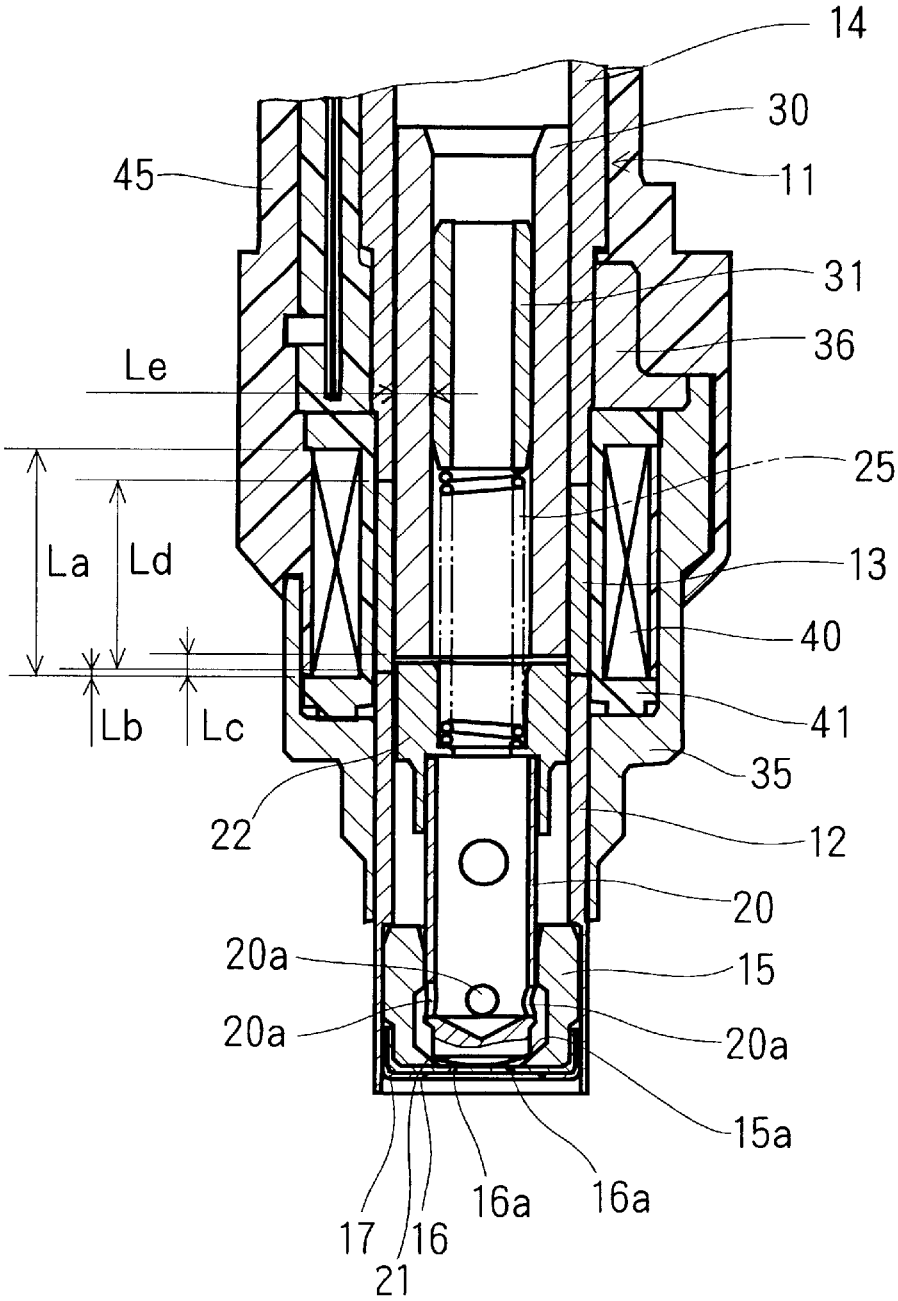
FIG. 1 is a partial enlarged cross-sectional view of a fuel injection device according to an embodiment of the present invention, showing a structure around a coil.
Figure 2:
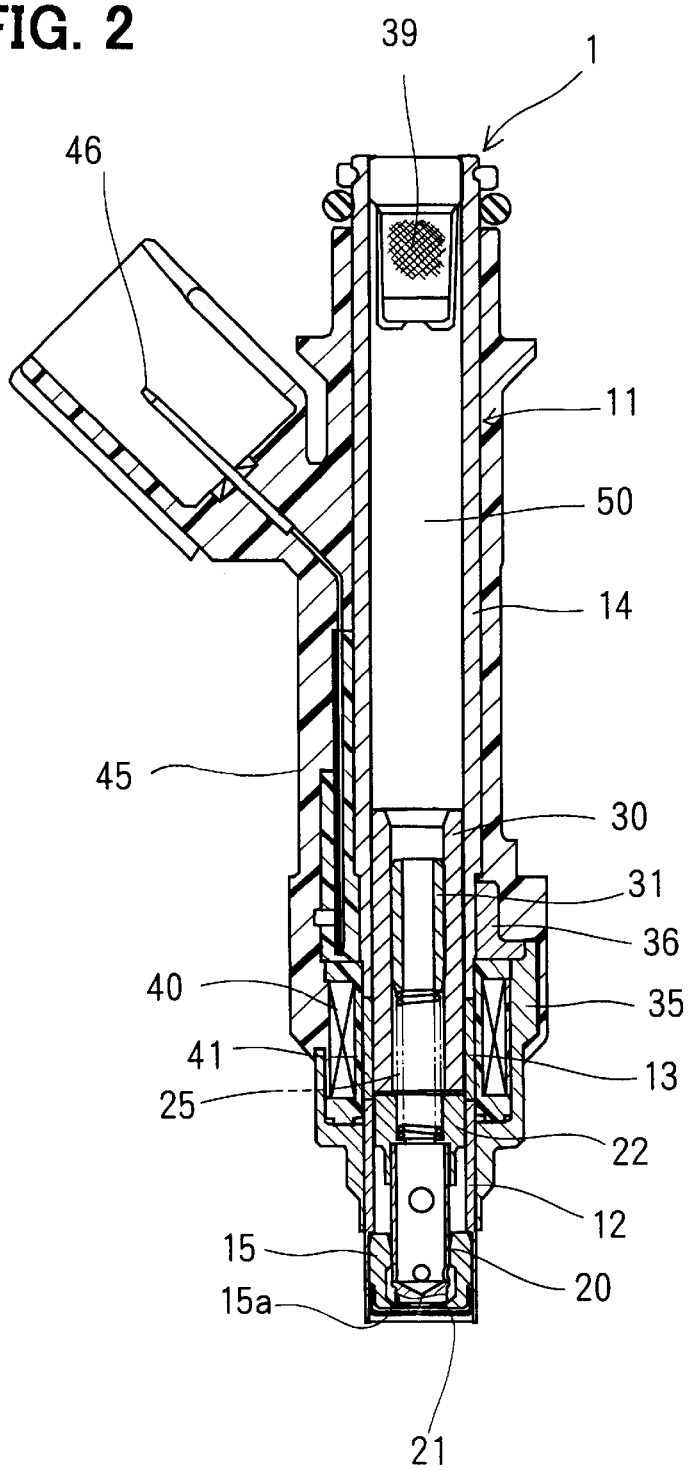
FIG. 2 is a cross-sectional view of the fuel injection device according to the embodiment.
Figure 3A:
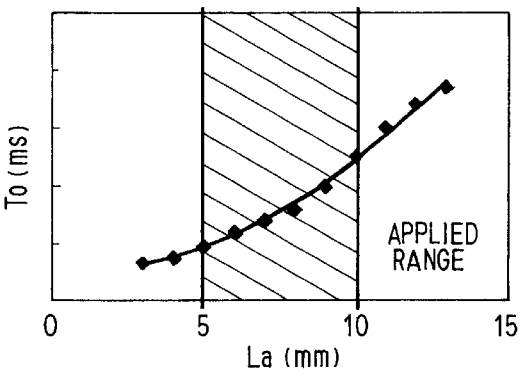
FIG. 3A is a graph showing a relationship between an axial length of a coil and a valve opening period.
Figure 3B:
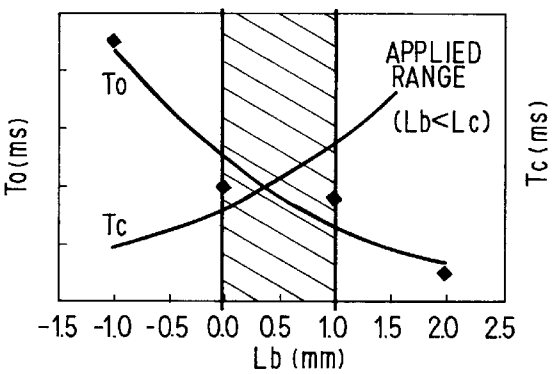
FIG. 3B is a graph showing a relationship between an axial distance between a downstream end surface of the coil and a downstream end surface of a non-magnetic portion and a valve opening period as well as a valve closing period.
Figure 3C:
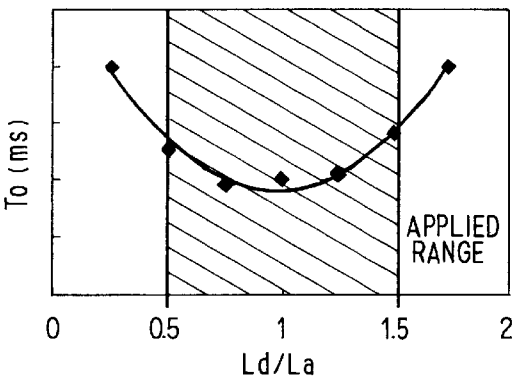
FIG. 3C is a graph showing a relationship between a ratio of an axial length of the non-magnetic portion/an axial length of the coil and a valve opening time.
Figure 3D:
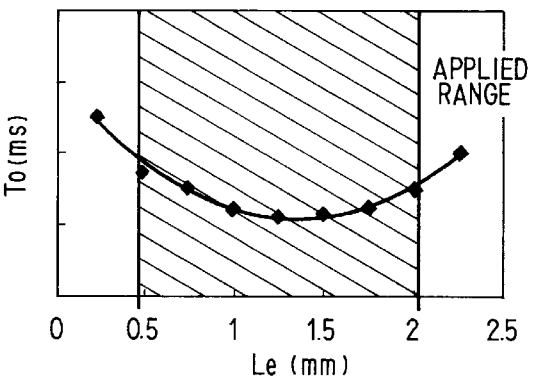
FIG. 3D is a graph showing a relationship between a wall thickness of a stationary core and a valve opening period.

With reference to FIGS. 1 and 2, a valve housing (cylindrical member) 11 of the fuel injection device 1 is shaped as a cylindrical body, which includes magnetic portions and a nonmagnetic portion, and is made, for example, of a compound magnetic material. A fuel passage 50 is formed in the valve housing 11. The fuel passage 50 receives a valve body 15, a valve member 20, a spring (serving as an urging means) 25, a stationary core 30, an adjusting pipe 31 and a filter 39.

The valve housing 11 has a first magnetic portion 12, a non-magnetic portion (serving as a magnetic shield portion or magnetic resisting portion) 13 and a second magnetic portion 14, which are formed as an integral body and are arranged in this order from a downstream end of the valve housing 11 located at a lower end in FIG. 2 toward an upstream end of the valve housing 11 located at an upper end in FIG. 2. The first magnetic portion 12 and the second magnetic portion 14 are magnetized, and the non-magnetic portion 13 is demagnetized by heating a corresponding portion of the valve housing 11. The non-magnetic portion 13 restrains a short circuit of the magnetic flux between the first magnetic portion 12 and the second magnetic portion 14. As shown in FIG. 1, a valve body 15 and an injection hole plate 16 having a cup shape are received in a downstream end of the first magnetic portion 12 (i.e., a lower end of the first magnetic portion 12 in FIG. 1).

The injection hole plate 16 is secured to an outer circumferential wall of the valve body 15 along with a cup shaped support member 17 by laser welding such that the injection hole plate 16 is clamped between the valve body 15 and the support member 17. The injection hole plate 16 is made of a thin plate material and has a plurality of injection holes 16*a*, which extend through the injection hole plate 16 at the center of the injection hole plate 16.

The valve member 20 has a cup shaped cylindrical body and includes an abutting portion 21 at a bottom side of the valve member 20. The abutting portion 21 of the valve member 20 can be seated against a valve seat 15*a* formed in an inner circumferential wall of the valve body 15. When the abutting portion 21 of the valve member 20 is seated against the valve seat 15*a*, the injection holes 16*a* are closed to stop the fuel injection through the injection holes 16*a*. A movable core (or movable portion) 22 is secured to an upstream end of the valve member 20 (i.e., an upper end of the valve member 20 in FIG. 1), for example, by laser welding. The valve member 20 includes a plurality of fuel communicating holes 20*a*, which penetrate through a lateral wall of the valve member 20 on an upstream side of the abutting portion 21. Fuel, which is introduced into the vale member 20, flows outwardly through the fuel communicating holes 20*a* toward a valve arrangement, which is formed by the abutting portion 21 and the valve seat 15*a*.

The stationary core 30 is shaped as a cylindrical body and is received in the non-magnetic portion 13 and the second magnetic portion 14 such that the stationary core 30 opposes the movable core 22 on an upstream side of the movable core 22. The adjusting pipe 31 is press fitted into the stationary core 30. One end of the spring 25, which serves as the urging means, is engaged to the adjusting pipe 31, and the other end of the spring 25 is engaged to the movable core 22. A load of the spring 25 can be adjusted by adjusting an amount of insertion of the adjusting pipe 31 within the stationary core 30. The spring 25 urges the valve member 20 through the movable core 22 toward the valve seat 15*a*.

Magnetic members (magnetic housings) 35, 36 are arranged radially outward of a coil (or coil winding) 40 and are engaged with the first magnetic portion 12 and the second magnetic portion 14, respectively. The stationary core 30, the movable core 22, the first magnetic portion 12, the second magnetic portion 14 and the magnetic members 35, 36 form a magnetic circuit.

The filter 39 is fitted into an upstream side of the valve housing 11, which is located at an upper side in FIG. 2, to remove foreign particles contained in the fuel.

A spool 41, around which the coil 40 is wound, is attached to an outer circumferential wall of the valve housing 11. A connector 45, which is formed by resin molding, covers a radially outer portion of the coil 40 and a radially outer portion of the spool 41. A terminal 46 is embedded in the connector 45 and is electrically connected to the coil 40.

The fuel, which has passed through the filter 39 into the fuel passage 50 of the valve housing 11, is discharged from the injection holes 16*a* through a fuel passage of the adjusting pipe 31, a fuel passage of the stationary core 30, a fuel passage of the valve member 20, the fuel communicating holes 20*a* and a space defined between the abutting portion 21 and the valve seat 15*a* when the abutting portion 21 is lifted from the valve seat 15*a*.

In the fuel injection device 1, when the coil 40 is deenergized, the valve member 20 is moved in a downward direction (i.e., a valve closing direction) in FIG. 2 by the spring 25, so that the valve member 20 is seated against the valve seat 15*a* to close the injection holes 16*a*, thereby stopping the fuel injection.

When the coil 40 is energized, the magnetic flux generated in the coil 40 passes through the magnetic circuit, which surrounds the coil 40, so that the magnetic attractive force is generated between the stationary core 30 and the movable core 22. Then, the valve member 20 is attracted toward the stationary core 30, and the abutting portion 21 is lifted away from the valve seat 15*a*. In this way, the fuel is injected through the injection holes 16*a*.

Next, positions and sizes of the non-magnetic portion 13, the movable core 22, the stationary core 30 and the coil 40 will be described.

With reference to FIG. 1, an axial length of the coil 40 in a reciprocating direction of the valve member 20 is indicated by "La". An axial distance between a downstream end surface of the coil 40 and a downstream end surface of the non-magnetic portion 13 is indicated by "Lb". An axial distance between the downstream end surface of the coil 40 and the downstream end surface of the stationary core 30 is indicated by "Lc". An axial length of the non-magnetic portion 13 is indicated by "Ld". A wall thickness of the stationary core 30 is indicated by "Le". The following conditions need to be satisfied: $5\ \text{mm} \leqq La \leqq 10\ \text{mm}$, $0\ \text{mm} \leqq Lb \leqq 1.0\ \text{mm}$, $Lb < Lc$, $0\ \text{mm} \leqq Lc \leqq 1.0\ \text{mm}$, $0.5 \leqq Ld/La \leqq 1.5$ and $0.5\ \text{mm} \leqq Le \leqq 2.0\ \text{mm}$. When these conditions are satisfied a valve opening period (To) and a valve closing period (Tc) can be advantageously reduced as shown in FIGS. 3A to 3D.

Figure 4:
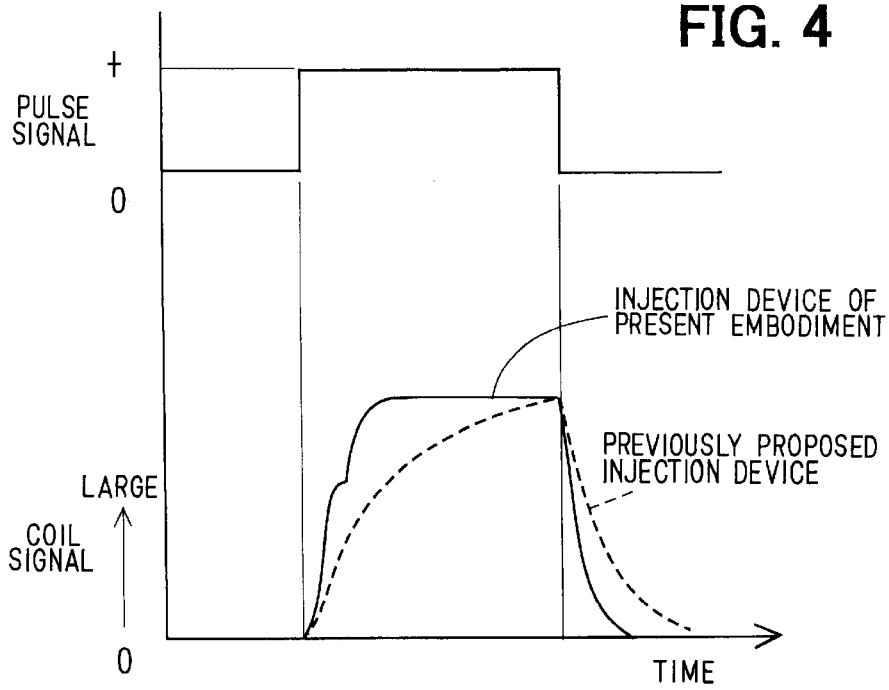
FIG. 4 is a graph showing a relationship between a pulse signal and a coil current with respect to time.
Figure 5:
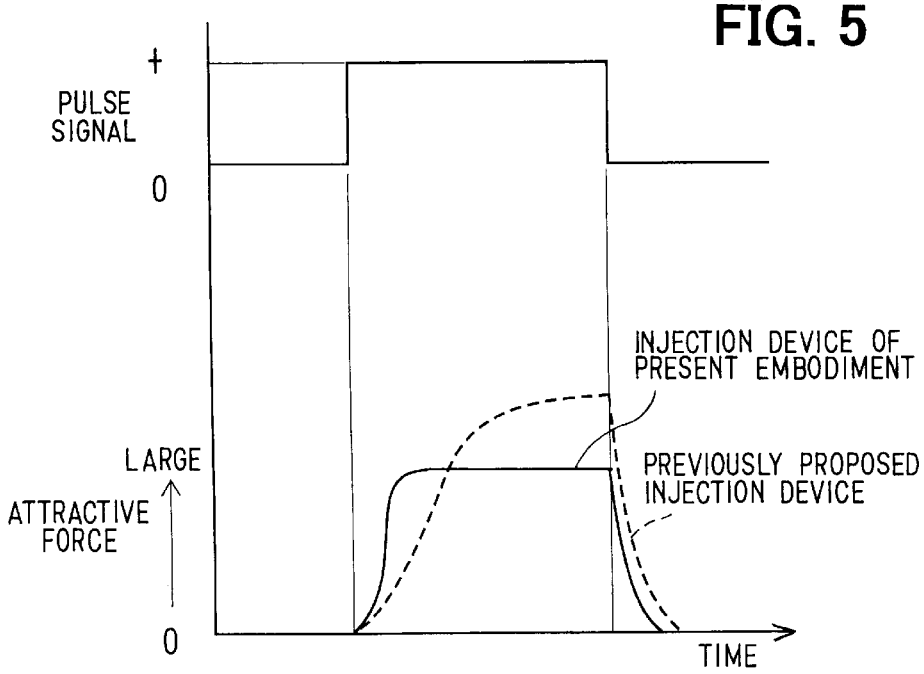
FIG. 5 is a graph showing a relationship between a pulse signal and an attractive force with respect to time.

More specifically, by setting $0.5 \leqq Ld/La \leqq 1.5$, the length of the non-magnetic portion 13 held within the coil 40 is increased, so that an inductance of the coil 40 becomes relatively small. Thus, as shown in FIGS. 4 and 5, when supply of the pulse signal to the coil 40 is turned on, the electric current, which flows through the coil 40, and an attractive force thus generated are more quickly increased, so that a valve opening period is advantageously reduced. When the supply of the pulse signal to the coil 40 is turned off, the electric current, which flows through the coil 40, and the attractive force thus generated are quickly reduced, so that a valve closing period is advantageously reduced. Furthermore, the reduction of the valve closing period results in a reduction of power consumption, so that the power consumption of the corresponding drive circuit can be reduced, and the engine can be operated at relatively high rotational speeds.

Furthermore, by setting $5\ \text{mm} \leqq La \leqq 10\ \text{mm}$, the length of the coil 40 is reduced, so that a length of the magnetic circuit is reduced, and thus a magnetic loss is reduced. With this arrangement, the electric current, which flows through the coil 40, and the attractive force thus generated are more quickly increased and are also more quickly reduced.

Also, by setting $0\ \text{mm} \leqq Lc \leqq 1.0\ \text{mm}$, the air gap between the movable core 22 and the stationary core 30, at which the relatively high magnetic flux density is desired, is more closely positioned to the end of the coil 40. Since the inductance of the coil 40 is reduced, the electric current, which flows through the coil 40, and the attractive force thus generated are more quickly increased and are also more quickly reduced.

When the electric current, which flows through the coil 40, and the attractive force thus generated are more quickly increased and are more quickly reduced, the valve opening period and the valve closing period of the fuel injection device 1 are reduced. Thus, the characteristics of the fuel injection rate of the fuel injection device 1 are more approximated to a waveform of the pulse signal applied to the coil 40. As a result, a pulse duration of the pulse signal applied to the coil 40 and the fuel injection amount are substantially proportioned relative to each other, so that the fuel injection amount can be more precisely controlled. Particularly, when the fuel injection amount is relatively small, for example, during idle operation of the engine, it is not necessary to excessively inject the fuel. Thus, the fuel consumption is improved, and the amount of noxious components contained in the exhaust gases is reduced.

It should be noted that even when the settings of $0\ \text{mm} \leqq Lc \leqq 1.0\ \text{mm}$ and $0.5\ \text{mm} \leqq Le \leqq 2.0$ among the above described settings are not satisfied, the valve opening period and the valve closing period of the fuel injection device can be still reduced.

In the above embodiment of the present invention, the positions of the non-magnetic portion 13, the movable core 22, the stationary core 30 and the coil 40 are adjusted, so that the valve opening period is advantageously reduced, and the valve closing period is also advantageously reduced without increasing the urging force of the spring. Furthermore, it is not required to increase the urging force of the spring, and thus it is not required to increase the number of turns of the coil to overcome the increased urging force of the spring, so that the size of the fuel injection device can be advantageously reduce.

Furthermore, in the above embodiment, the portion of the compound magnetic material is heated and is thus demagnetized to form the non-magnetic portion 13 serving as the magnetic shield portion. Alternative to this, it is possible to reduce the thickness of the corresponding portion of the magnetic material to form the magnetic shield portion.

Second Embodiment

A fuel injection device according to a second embodiment of the present invention will be described with reference to FIGS. 6 and 7. In the second embodiment, similar components to those described in the first embodiment are similarly labeled. A resin housing 10 is secured such that the resin housing 10 covers an outer circumferential wall of a cylindrical member 11. A stationary core 30 and a coil 40 are received radially inward of the resin housing 10.

Figure 6:
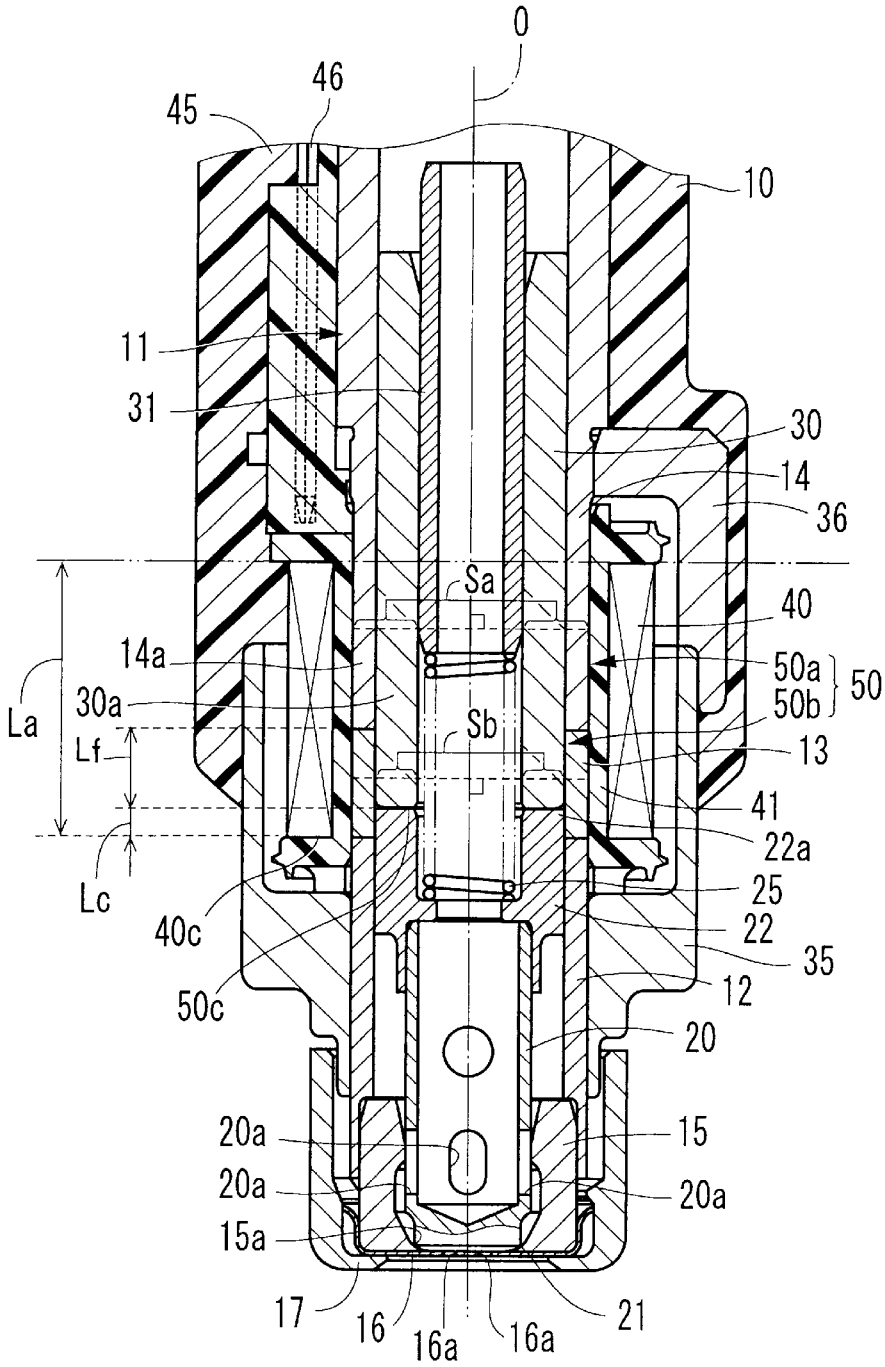
FIG. 6 is an enlarged partial cross-sectional view of a fuel injection device according to a second embodiment of the present invention, showing a structure around a coil.
Figure 7:
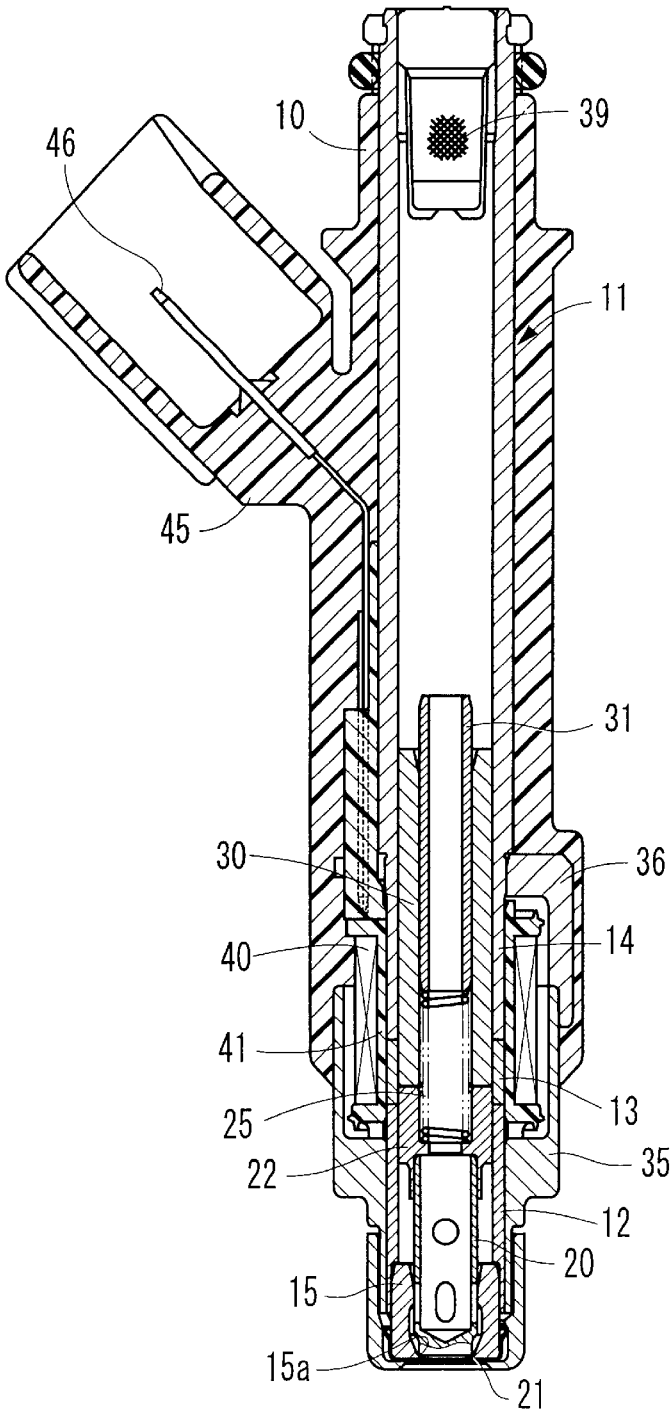
FIG. 7 is a cross-sectional view of the fuel injection device according to the second embodiment.

The cylindrical member 11 is shaped as a generally straight cylindrical body and includes a first magnetic portion 12, a non-magnetic portion (serving as a magnetic shield portion or magnetic resisting portion) 13 and a second magnetic portion 14, which are axially arranged in this order from a downstream end of the cylindrical member 11 (i.e., a lower end of the cylindrical member 11 in FIG. 6 or 7) to an upstream end of the cylindrical member 11 (i.e., an upper end of the cylindrical member 11 in FIG. 6 or 7). The first magnetic portion 12 and the second magnetic portion 14 are magnetized to exhibit magnetism, and the non-magnetic portion 13 is demagnetized. The non-magnetic portion 13 restrains a short circuit of a magnetic flux between the first magnetic portion 12 and the second magnetic portion 14. The coil 40 surrounds the non-magnetic portion 13 and a downstream end section 14*a* of the second magnetic portion 14 (i.e., a lower end section of the second magnetic portion 14 in FIG. 6). In FIG. 6, a boundary between the downstream end section 14*a* of the second magnetic portion 14 and an upstream section of the second magnetic portion 14 (i.e., an upper section of the second magnetic portion 14 other than the downstream end section 14*a* in FIG. 6) is indicated by a dot-dot-dash line.

The stationary core 30 is made of a magnetic material, such as an iron material, and is shaped as a generally straight cylindrical body. The stationary core 30 is secured to the resin housing 10 through the cylindrical member 11 at radially inward of the second magnetic portion 14 and the non-magnetic portion 13 and is arranged coaxial with the second magnetic portion 14 and the non-magnetic portion 13. Thus, an outer circumferential wall of the stationary core 30 is covered by the non-magnetic portion 13 and the second magnetic portion 14, and a downstream end section 30*a* of the stationary core 30 (i.e., a lower end section of the stationary core 30 in FIG. 6) is surrounded by the coil 40. In FIG. 6, a boundary between the downstream end section 30*a* of the stationary core 30, which is surrounded by the coil 40, and an upstream section of the stationary core 30 (i.e., an upper section of the stationary core 30 other than the downstream end section 30*a* in FIG. 6) is also indicated by the above-described dot-dot-dash line. In the present embodiment, the downstream end section 30*a* of the stationary core 30 and the downstream end section 14*a* of the second magnetic portion 14 cooperatively form a stationary portion 50, in which a main portion 50*a* and a reduced size portion 50*b* are axially arranged. Specifically, a part of the end section 30*a* of the stationary core 30, which is covered by the end section 14*a* of the second magnetic portion 14, and the end section 14*a* of the second magnetic portion 14 cooperatively form the main portion 50*a*. Furthermore, a part of the end section 30*a* of the stationary core 30, which is covered by the non-magnetic portion 13, forms the reduced size portion 50*b*. A cross-sectional area of the reduced size portion 50*b* in a plane perpendicular to an axis O of the stationary core 30 and thus of the cylindrical member 11 is smaller than a cross-sectional area of the main portion 50*a* in a plane perpendicular to the axis O. Here, the reduced size portion 50*b* means that a cross-sectional area Sb of the reduced size portion 50*b* in the plane perpendicular to the axis O is reduced in comparison to a cross-sectional area Sa of the main portion 50*a*. A downstream end surface of the stationary core 30, which also serves as a downstream end surface 50*c* of the stationary portion 50, is a planar surface that extends in the direction perpendicular to the axis O.

A valve body 15 is secured to an inner circumferential surface of a downstream end section of the first magnetic portion 12 (i.e., a lower end section of the first magnetic portion 12 in FIG. 6). A cup shaped injection hole plate 16 is secured to an outer circumferential wall of the valve body 15 together with a cup shaped support member 17 by laser welding such that the injection hole plate 16 is clamped between the valve body 15 and the support member 17. The injection hole plate 16 is made of a thin plate material and has the injection holes 16*a*, which extend through the injection hole plate 16 at the center of the injection hole plate 16.

The valve member 20 is shaped as a cup shaped cylindrical body and is axially reciprocably received in the valve body 15 and the cylindrical member 11. The valve member 20 includes an abutting portion 21 at a bottom wall of the valve member 20 (i.e., a lower end wall of the valve member 20 in FIG. 6). The abutting portion 21 can be seated against a valve seat 15*a* formed in an inner circumferential wall of the valve body 15. When the abutting portion 21 of the valve member 20 is seated against the valve seat 15*a*, the injection holes 16*a* are closed to stop the fuel injection through the injection holes 16*a*. The valve member 20 includes a plurality of fuel communicating holes 20*a*, which penetrate through a lateral wall of the valve member 20 on an upstream side of the abutting portion 21. Fuel, which is introduced into the vale member 20, flows outwardly through the fuel communicating holes 20*a* toward a valve arrangement, which is formed by the abutting portion 21 and the valve seat 15*a*.

A movable core (serving as a movable portion) 22 is made of a magnetic material and is shaped as a cylindrical body. The movable core 22 is secured to an upstream end of the valve member 20 (i.e., an upper end of the valve member 20 in FIG. 6), for example, by laser welding. The movable core 22 can reciprocate together with the valve member 20. The movable core 22 is arranged within the cylindrical member 11 on a downstream side of the downstream end section 30*a* of the stationary core 30, which serves as a part of the stationary portion 50. Furthermore, an upstream end section 22*a* of the movable core 22 is opposed to the downstream end section 30*a* of the stationary core 30.

An adjusting pipe 31, which is demagnetized, is press fitted into the stationary core 30. One end of a spring 25, which serves as an urging means, is engaged to the adjusting pipe 31, and the other end of the spring 25 is engaged to the movable core 22. A load of the spring 25 can be adjusted by adjusting an amount of insertion of the adjusting pipe 31 within the stationary core 30. The spring 25 urges the valve member 20 through the movable core 22 toward the valve seat 15*a*.

Magnetic housings (magnetic members) 35, 36 are made of a magnetic material and are secured to a radially outer side of the coil 40. The magnetic housing 35 is engaged with the first magnetic portion 12, and the magnetic housing 36 is engaged with the second magnetic portion 14. In the present embodiment, the resin housing 10, the valve body 15 and the magnetic housings 35, 36 form a body.

A spool 41 is made of a resin material and is arranged such that the spool 41 covers an outer circumferential wall of the cylindrical member 11. The coil 40 is wound around the spool 41. Thus, the coil 40 is coaxial with and is positioned radially outward of the stationary portion 50, which includes the end section 30*a* of the stationary core 30 and the end section 14*a* of the second magnetic portion 14. A downstream end surface 40*c* of the coil 40 (a lower end surface of the coil 40 in FIG. 6) is arranged in a plane that is perpendicular to the axis O on a downstream side of the downstream end surface 50*c* of the stationary portion 50. A terminal 46 is embedded in a connector 45 of the resin housing 10 that covers the coil 40 and the spool 41. The coil 40 is electrically connected to the terminal 46. When the coil 40 is energized through the terminal 46, the coil 40, the stationary portion 50, the first magnetic portion 12, the movable core 22 and the magnetic housings 35, 36 form a magnetic circuit.

A filter 39 is securely fitted into an upstream end section of the cylindrical member 11 (i.e., an upper end section of the cylindrical member 11 in FIG. 7) to remove foreign particles contained in the fuel. The fuel, which has passed through the filter 39 and is introduced into the fuel passage of the cylindrical member 11, is injected from the injection holes 16*a* through a fuel passage of the adjusting pipe 31, a fuel passage of the stationary core 30, a fuel passage of the movable core 22, a fuel passage of the valve member 20, the fuel communicating holes 20*a* and a space defined between the abutting portion 21 and the valve seat 15*a* when the abutting portion 21 is lifted from the valve seat 15*a*.

In the fuel injection device, when the coil 40 is deenergized by turning off supply of the pulse signal to the coil 40, the valve member 20, which is urged by the urging force of the spring 25, is moved together with the movable core 22 in a downward direction (i.e., a valve closing direction) in FIG. 7, so that the abutting portion 21 of the valve member 20 is seated against the valve seat 15*a* to close the injection holes 16*a*, thereby stopping the fuel injection.

When energization of the coil 40 is initiated by turning on the supply of the pulse signal to the coil 40, the magnetic flux generated by the coil 40 passes through the magnetic circuit, so that the magnetic attractive force is generated between the end section 30*a* of the stationary core 30 and an opposed end section 22*a* of the movable core 22. Then, the valve member 20 is magnetically attracted toward the stationary core 30 against the forces, which include the urging force of the spring 25 and the fuel pressure in the fuel passage, so that the valve member 20 moves in an upward direction (i.e., a valve opening direction) in FIG. 7. Thus, the abutting portion 21 of the valve member 20 is lifted from the valve seat 15*a* to release the injection holes 16*a*, so that the fuel is injected from the injection holes 16*a*.

Next, with reference to FIG. 6, settings of the cross-sectional area Sa of the main portion 50*a*, the cross-sectional area Sb of the reduced size portion 50*b*, an axial length Lf of the reduced size portion 50*b*, an axial length La of the coil 40 and an axial distance Lc between the downstream end surface 40*c* of the coil 40 and the downstream end surface 50*c* of the stationary portion 50 will be described. (1) The cross-sectional area Sa of the main portion 50*a* and the cross-sectional area Sb of the reduced size portion 50*b* are selected such that a ratio of Sb/Sa is in a range of $0.2 \leqq Sb/Sa \leqq 0.9$. Furthermore, the axial length La of the coil 40, the axial length Lf of the reduced size portion 50*b* and the axial distance Lc between the end surface 40*c* of the coil 40 and the end surface 50*c* of the stationary portion 50 are selected such that a ratio of (Lf+Lc)/La is in a range of $0.1 \leqq (Lf+Lc)/La \leqq 1.0$.

Figure 8A:
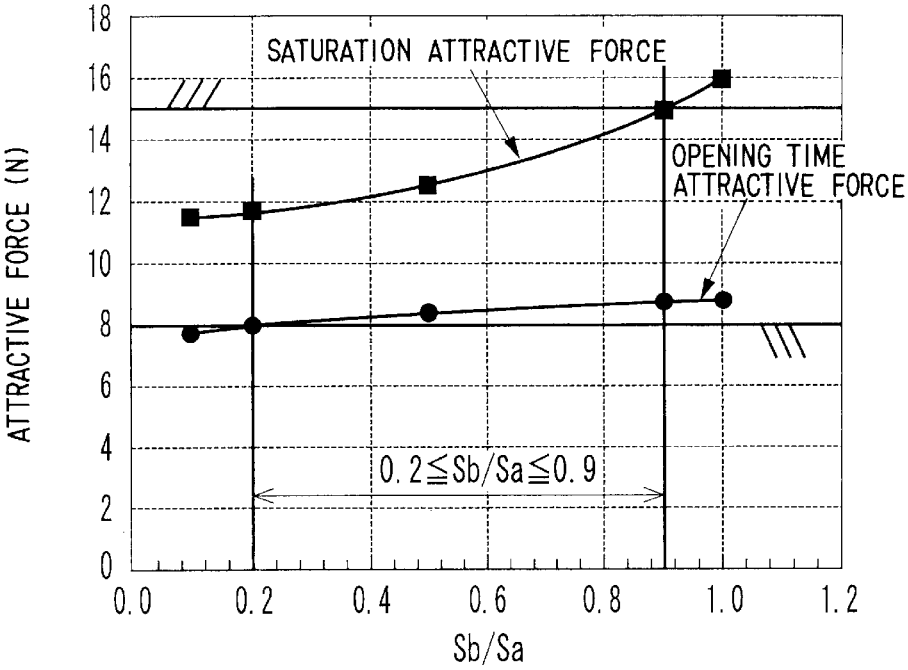
FIG. 8A is a graph showing a relationship between a ratio of Sb/Sa and an attractive force.
Figure 8B:
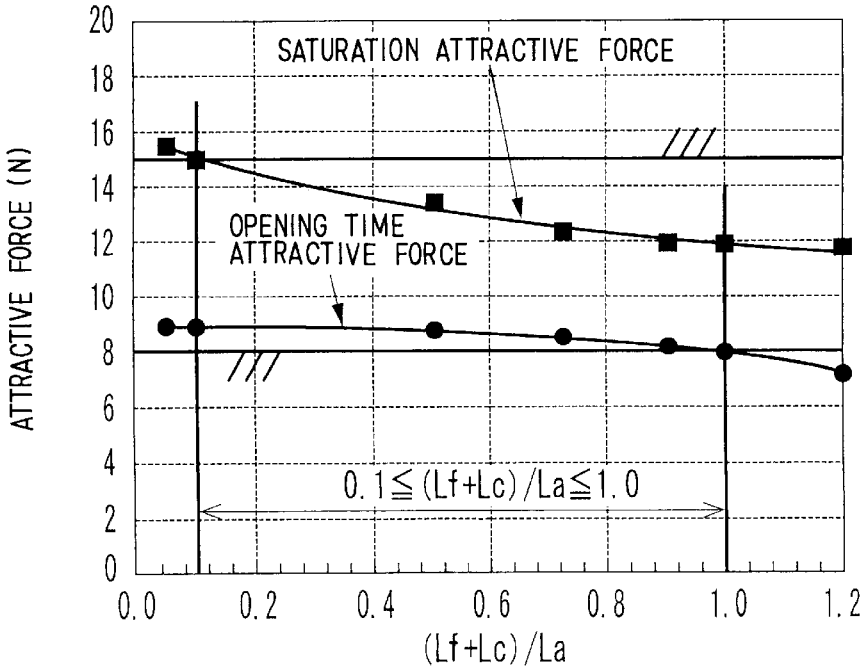
FIG. 8B is a graph showing a relationship between a ratio of (Lf+Lc)/La and an attractive force.

When the ratio of Sb/Sa is equal to or greater than 0.2, and the ratio of (Lf+Lc)/La is equal to or less than 1.0, a volume of the passing magnetic flux in the magnetic circuit can be increased. In this way, a valve opening time attractive force (i.e., an attractive force exerted at time of valve opening) for attracting the movable core 22 is increased to attract the movable core 22, which currently places the valve member 20 in the seated state on the valve seat 15*a*, against the forces, which include the urging force of the spring 25 and the fuel pressure, at the time of valve opening, as shown in FIGS. 8A and 8B. When the ratio of Sb/Sa becomes less than 0.2 or when the ratio of (Lf+Lc)/La exceeds 1.0, the valve opening time attractive force is reduced below 8 N, as shown in FIGS. 8A and 8B, so that the movable core 22 cannot be attracted and moved toward the stationary core 30.

Figure 9:
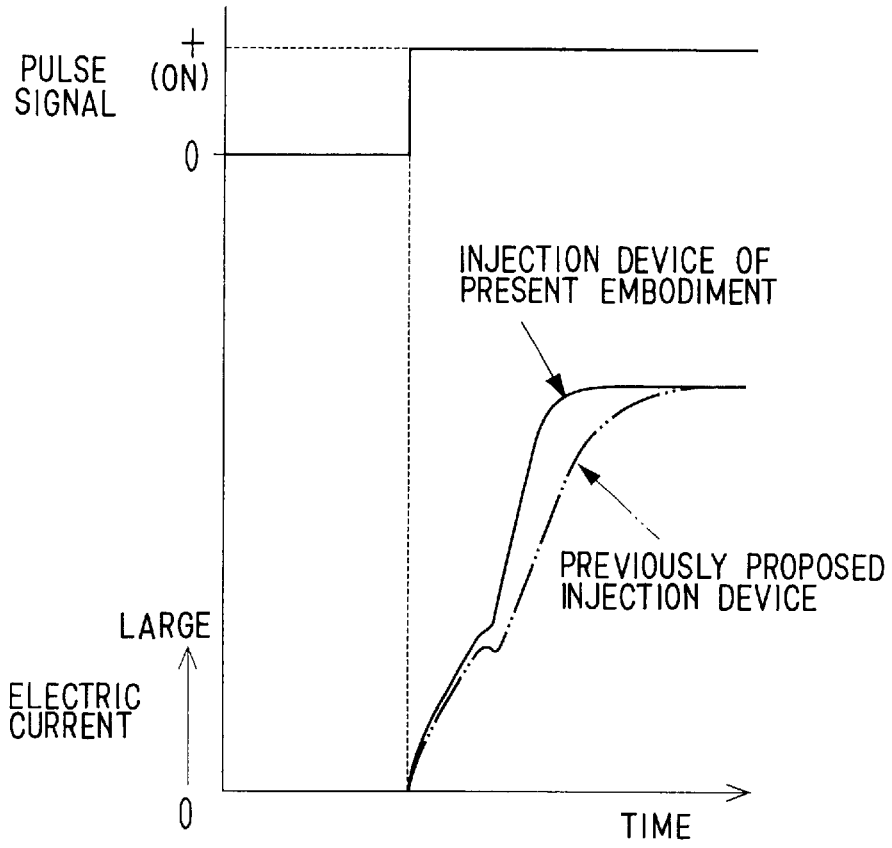
FIG. 9 is a graph showing a relationship between a time and an electric current value supplied to the coil.

Furthermore, when the ratio of Sb/Sa is equal to or less than 0.9, and the ratio of (Lf+Lc)/La is equal to or greater than 0.1, an increase in the volume of the passing magnetic flux can be restrained. Thus, increases of the attractive forces, which include a saturation attractive force at time of full lift of the movable core 22 in the valve opening directing and the above-described valve opening time attractive force, are restrained, for example, as shown in FIGS. 8A and 8B. Since the increases of the attractive forces are restrained, an increase of an inductance in the magnetic circuit is also restrained. As a result, when the supply of the pulse signal to the coil 40 is turned on, the electric current, which flows through the coil 40, is quickly increased, as shown in FIG. 9. Because of this effect and the increase of the valve opening time attractive force, the movable core 22 is quickly moved in the valve opening direction to lift the valve member 20 from the valve seat 15*a* at the time of energization of the coil 40, so that a valve opening period is advantageously reduced. Furthermore, since the increase of the saturation attractive force is restrained, the movable core 22 is quickly moved in the valve closing direction to quickly seat the valve member 20 against the valve seat 15*a* at the time of deenergization of the coil 40, so that a valve closing period is advantageously reduced. When the ratio of Sb/Sa exceeds 0.9, or when the ratio of (Lf+Lc)/La is less than 0.1, the saturation attractive force exceeds 15N, as shown in FIGS. 8A and 8B, so that the valve closing period is disadvantageously increased. (2) The axial length La of the coil 40 is in the range of $4\ mm \leqq La \leqq 12\ mm$.

Figure 10:
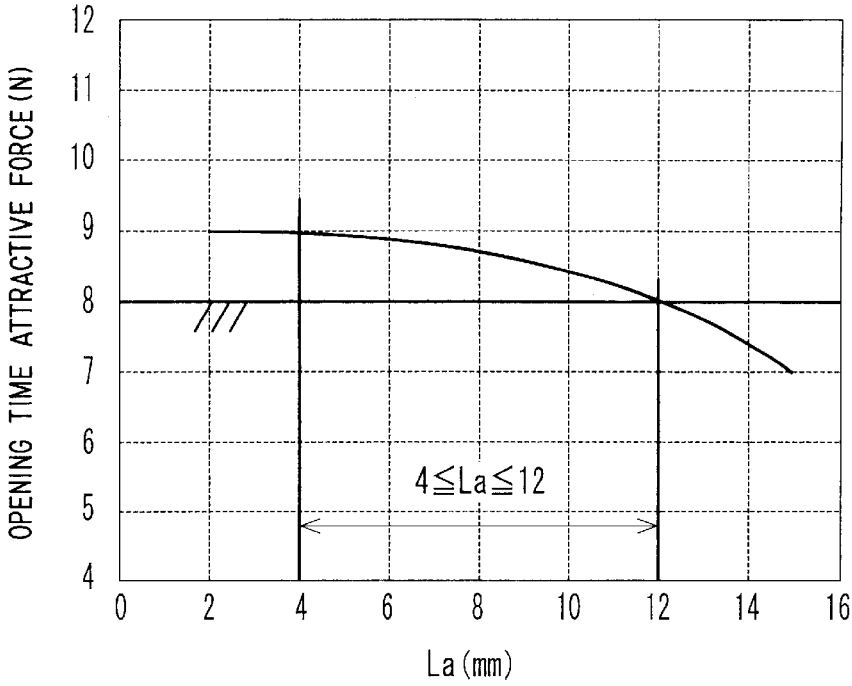
FIG. 10 is a graph showing a relationship between an axial length of the coil and a valve opening time attractive force.

As shown in FIG. 10, when the axial length La of the coil 40 is equal to or greater than 4 mm and is also equal to or less than 12 mm, the valve opening time attractive force of greater than or equal to 8 N can be reliably achieved without a substantial increase of a radial size of the coil 40. Thus, the valve opening period is reliably reduced. (3) The cross-sectional area Sb of the reduced size portion 50*b* is in the range of 11 $mm^2 \leqq Sb \leqq 28\ mm^2$.

Figure 11:
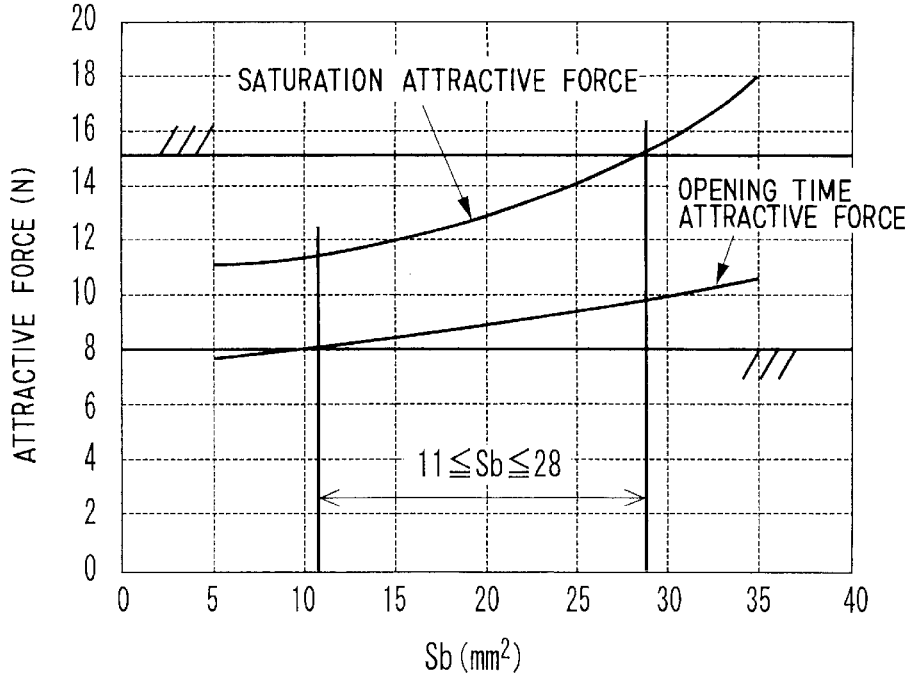
FIG. 11 is a graph showing a relationship between a cross-sectional area of a reduced size portion and an attractive force.

When the cross-sectional area Sb of the reduced size portion 50*b* is equal to or greater than 11 $mm^2$, the valve opening time attractive force becomes equal to or greater than 8 N, so that the valve member 20 can be quickly and reliably lifted from the valve seat 15*a*, as shown in FIG. 11. Furthermore, when the cross-sectional area Sb of the reduced size portion 50*b* is equal to or less than 28 $mm^2$, the saturation attractive force becomes equal to or less than 15 N, as shown in FIG. 11, so that the valve member 20 can be quickly seated against the vale seat 15*a*. As a result, the valve opening period and the valve closing period can be reliably reduced.

With the above-described settings, the valve opening period and the valve closing period of the fuel injection device are reduced. Thus, the fuel injection rate characteristics of the fuel injection device are approximated to a waveform of the pulse signal applied to the coil 40. As a result, a pulse duration of the pulse signal applied to the coil 40 and the fuel injection amount are substantially proportioned relative to each other, so that the fuel injection amount can be more precisely controlled. Particularly, when the fuel injection amount is relatively small, for example, during idle operation of the engine, it is not necessary to excessively inject the fuel. Thus, the fuel consumption of the engine is improved, and the amount of noxious components contained in the exhaust gases is reduced.

Among the above settings, the settings described in the above sections (2) and (3) can be changed based on a corresponding specification of the fuel injection device within a range that allows a reduction of the valve closing period and a reduction of the valve opening period.

Third to Sixth Embodiments

FIGS. 12 to 15 show fuel injection devices according to third to sixth embodiments, respectively, of the present invention. In each of the third to sixth embodiments, components similar to those of the second embodiment are labeled similarly.

Figure 12:
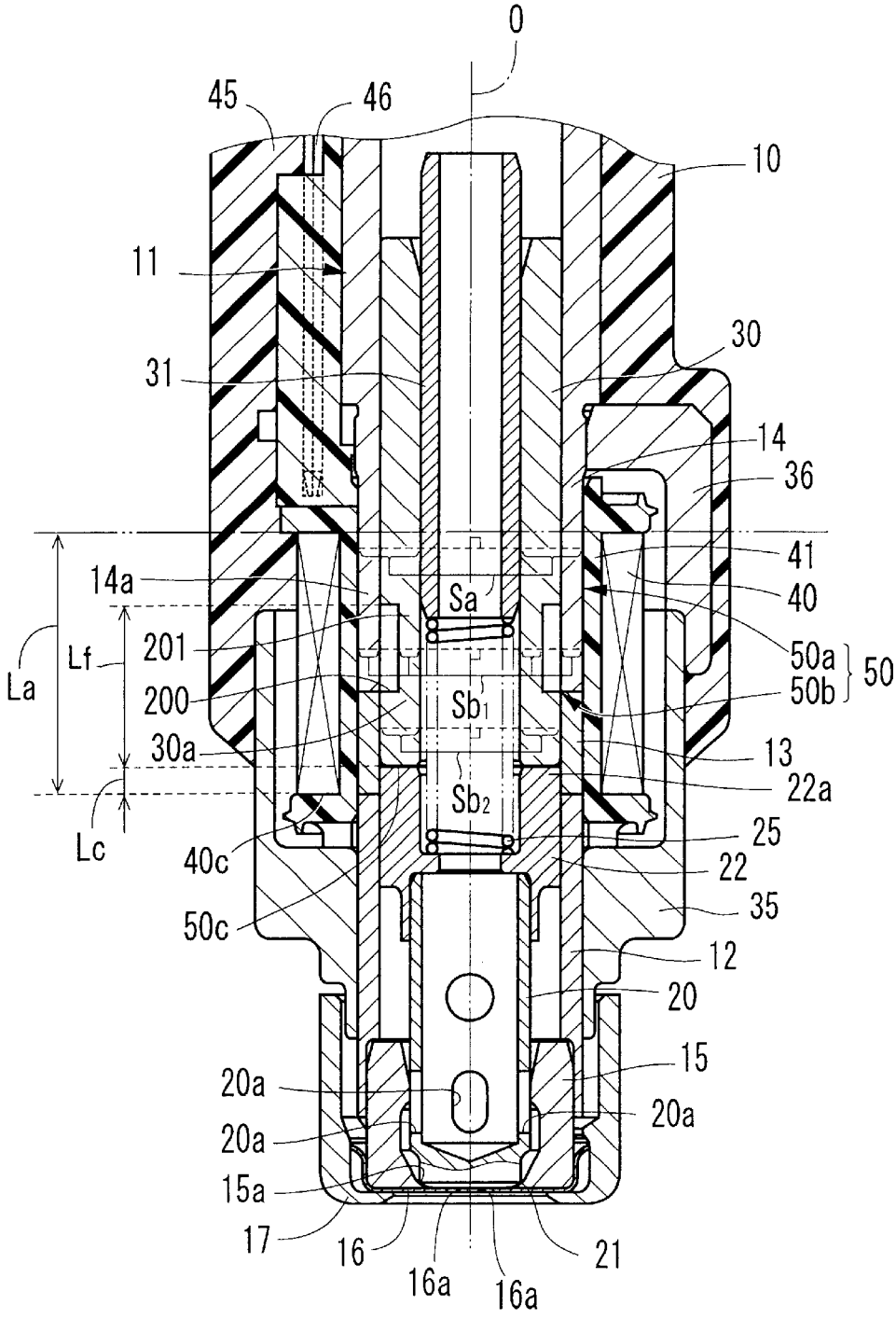
FIG. 12 is an enlarged partial cross-sectional view of a fuel injection device according to a third embodiment of the present invention, showing a structure around a coil.
Figure 13:
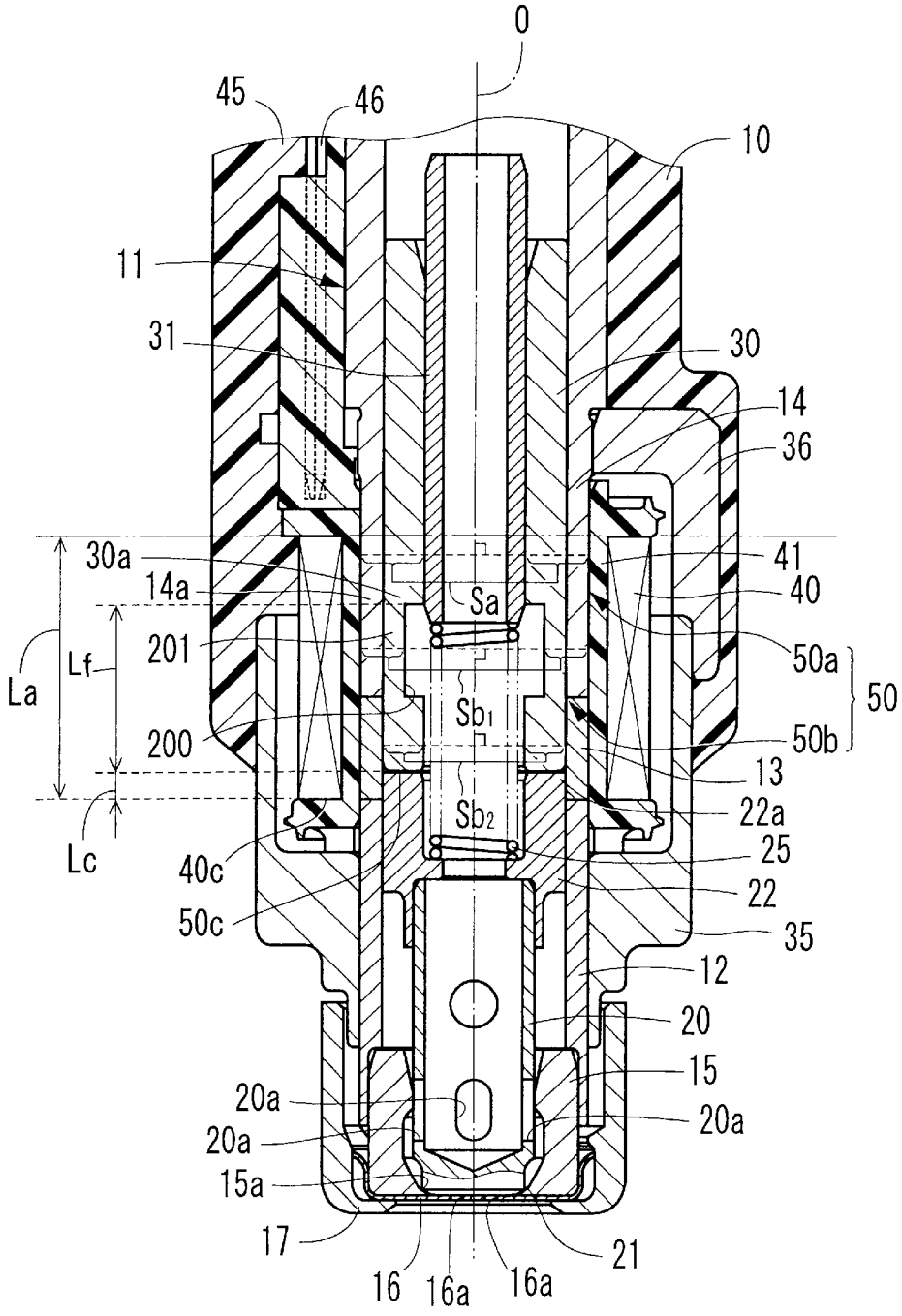
FIG. 13 is an enlarged partial cross-sectional view of a fuel injection device according to a fourth embodiment of the present invention, showing a structure around a coil.

In each of the fuel injection device according to the third embodiment shown in FIG. 12 and the fuel injection device according to the fourth embodiment shown in FIG. 13, a downstream end section 30*a* of a stationary core 30 includes an annular groove 200, which extends in a circumferential direction at a part of the downstream end section 30*a* of the stationary core 30, which is covered by a downstream end section 14*a* of a second magnetic portion 14 and is located adjacent to another part of the downstream end section 30*a* of the stationary core 30, which is covered by a non-magnetic portion 13. In the third embodiment, the annular groove 200 is provided in an outer circumferential wall of the stationary core 30. In the fourth embodiment, the annular groove 200 is provided in an inner circumferential wall of the stationary core 30.

Similar to the second embodiment, in the third and fourth embodiments, the downstream end section 30*a* of the stationary core 30 and the downstream end section 14*a* of the second magnetic portion 14, which are surrounded by a coil 40, form a stationary portion 50. However, unlike the second embodiment, a part of the end section 30*a*, which is covered by the second magnetic portion 14 and is other than a base wall 201 of the annular groove 200, and a part of the end section 14*a*, which covers the part of the end section 30*a* other than the base wall 201, cooperatively form a main body 50*a*. Furthermore, a part of the end section 14*a*, which covers the base wall 201, a part of the end section 30*a*, which forms the base wall 201, and a part of the end section 30*a*, which is covered by the non-magnetic portion 13, cooperatively form a reduced size portion 50*b*.

With reference to FIGS. 12 and 13, in the third and fourth embodiments, a cross-sectional area Sa of the main portion 50*a*, a cross-sectional area Sb (Sb1, Sb2) of the reduced size portion 50*b*, an axial length Lf of the reduced size portion 50*b*, an axial length La of the coil 40 and an axial distance Lc between a downstream end surface 40*c* of the coil 40 and a downstream end surface 50*c* of the stationary portion 50 are the same as those of the second embodiment. Here, the cross-sectional area Sb1 is measured in a plane that extends perpendicular to an axis O through the part of the end section 30*a*, which forms the base wall 201. The cross-sectional area Sb2 is measured in a plane that extends perpendicular to the axis O through the part of the end section 30*a*, which is covered by the non-magnetic portion 13. It should be noted that as long as $0.2 \leqq Sb/Sa \leqq 0.9$ is satisfied, the cross-sectional area Sb of the reduced size portion 50*b* can be selected such that the cross-sectional area Sb1 and the cross-sectional area Sb2 are different from each other or are the same.

Figure 14:
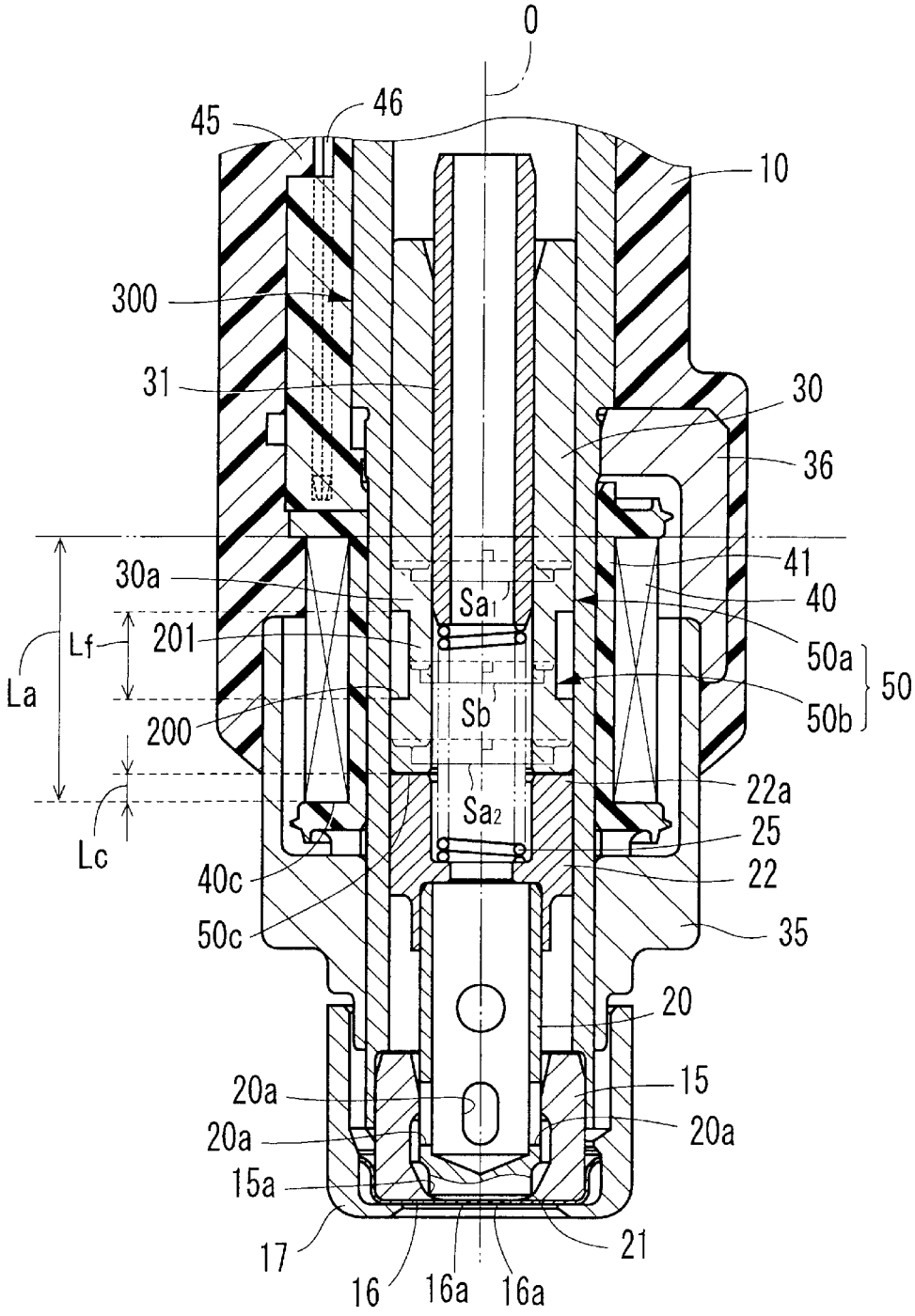
FIG. 14 is an enlarged partial cross-sectional view of a fuel injection device according to a fifth embodiment of the present invention, showing a structure around a coil.

The fuel injection device according to the fifth embodiment shown in FIG. 14 includes an annular groove 200, which is similar to the annular groove 200 of the third embodiment, in an outer circumferential wall of the stationary core 30. The fuel injection device according the fifth embodiment also includes a cylindrical member 300, which is entirely demagnetized, in place of the cylindrical member 11 of the third embodiment. The fuel injection device according to the sixth embodiment shown in FIG. 15 includes an annular groove 200, which is similar to the annular groove 200 of the fourth embodiment, in an inner circumferential wall of the stationary core 30. The fuel injection device according to the sixth embodiment also includes a cylindrical member 400, which is entirely demagnetized, in place of the cylindrical member 11 of the fourth embodiment.

In each of the fifth and sixth embodiments, a downstream end section 30*a* of the stationary core 30, which is surrounded by the coil 40, forms a stationary portion 50. Specifically, each part of the end section 30*a* other than a base wall 201 of the annular groove 200 forms a main portion 50*a* of the stationary portion 50, and a part of the end section 30*a*, which forms the base wall 201, constitutes a reduced size portion 50*b*.

Figure 15:
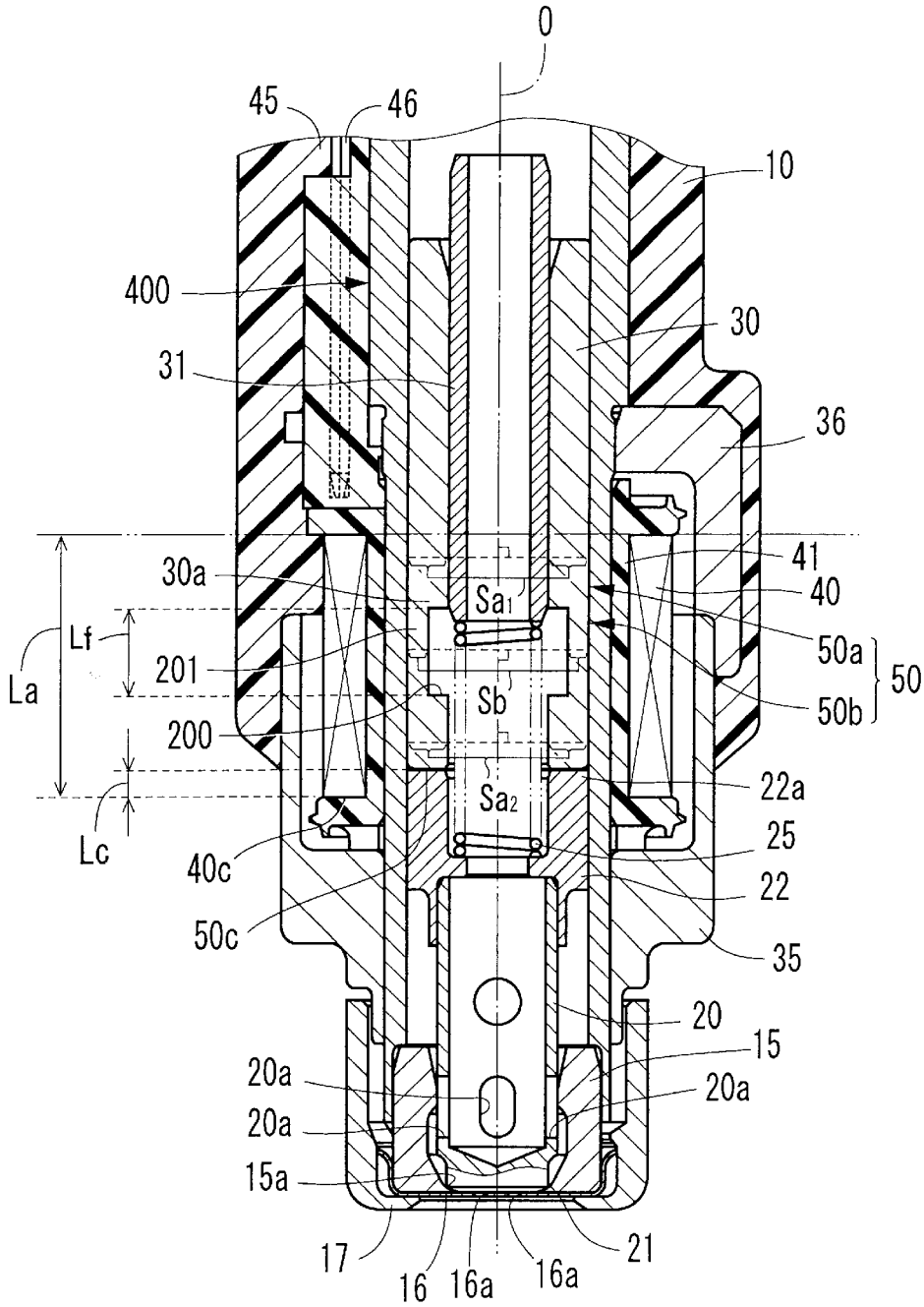
FIG. 15 is an enlarged partial cross-sectional view of a fuel injection device according to a sixth embodiment of the present invention, showing a structure around a coil.

Furthermore, with reference to FIGS. 14 and 15, in each of the fifth and sixth embodiments, a cross-sectional area Sa (Sa1, Sa2) of the main portion 50*a*, a cross-sectional area Sb of the reduced size portion 50*b*, an axial length Lf of the reduced size portion 50*b*, an axial length La of the coil 40 and an axial distance Lc between a downstream end surface 40*c* of the coil 40 and a downstream end surface 50*c* of the stationary portion 50 are the same as those of the second embodiment. Here, the cross-sectional area Sal is measured in a plane that extends perpendicular to an axis O through a part of the end section 30*a*, which is located on an upstream side of the base wall 201 (i.e., on an upper side of the base wall 201 in FIG. 14). The cross-sectional area Sa2 is measured in a plane that extends perpendicular to the axis O through a part of the end section 30*a*, which is located on a downstream side of the base wall 201 (i.e., on a lower side of the base wall 201 in FIG. 14). It should be noted that as long as 0.2≦Sb/Sa≦0.9 is satisfied, the cross-sectional area Sa of the main portion 50*a* can be selected such that the cross-sectional area Sa1 and the cross-sectional area Sa2 are the same.

Seventh Embodiment

Figure 16:
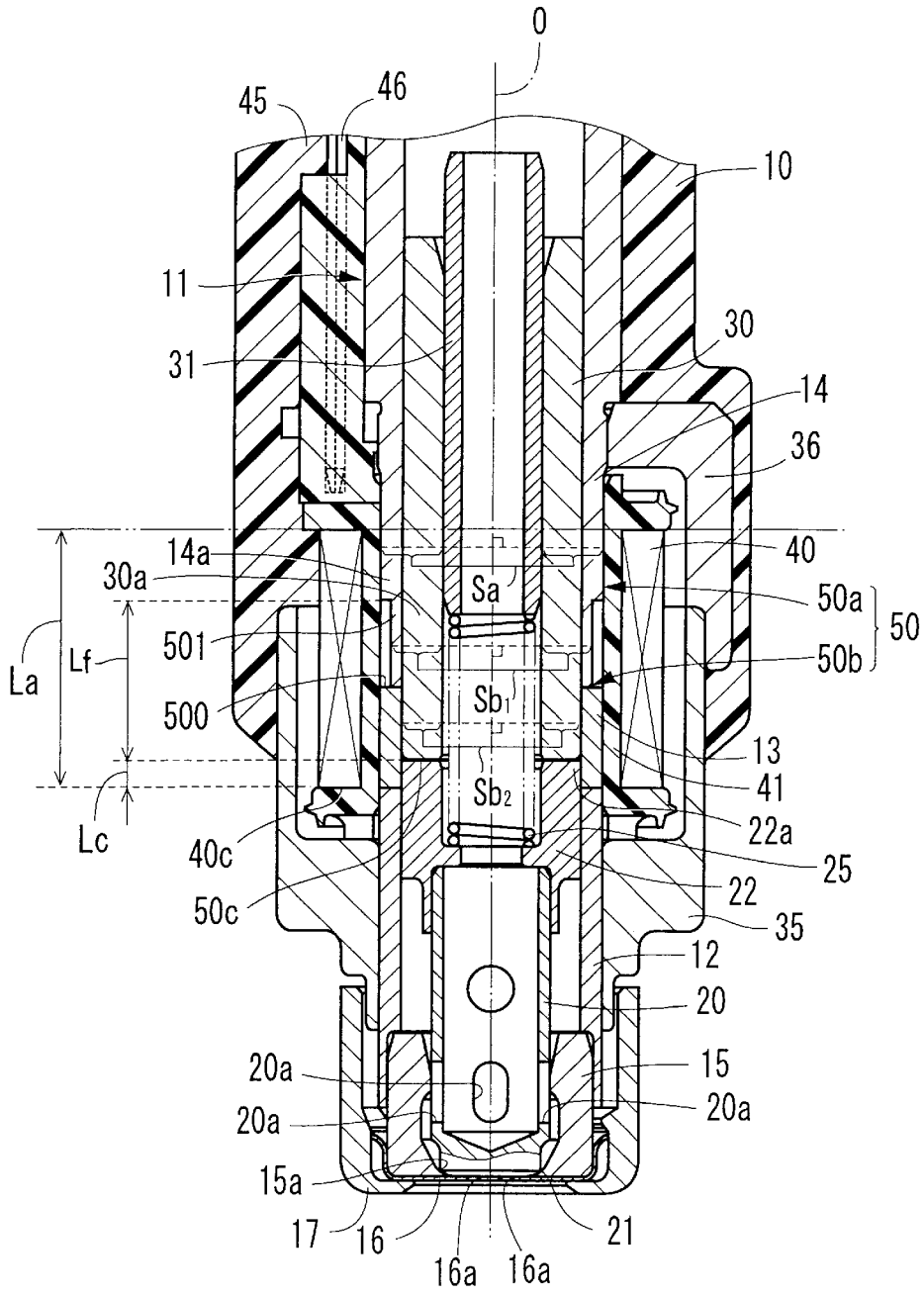
FIG. 16 is an enlarged partial cross-sectional view of a fuel injection device according to a seventh embodiment of the present invention, showing a structure around a coil.

FIG. 16 shows a fuel injection device according to a seventh embodiment of the present invention. In the seventh embodiment, components similar to those of the second embodiment are labeled similarly.

In the fuel injection device of the seventh embodiment shown in FIG. 16, a cylindrical member 11 includes an annular groove 500, which extends in a circumferential direction at a part of a downstream end section 14*a* of a second magnetic portion 14, which is located adjacent to the non-magnetic portion 13. In the present embodiment, although the annular groove 500 is arranged in an outer circumferential wall of the second magnetic portion 14, the annular groove 500 can be alternatively provided in an inner circumferential wall of the second magnetic portion 14.

Similar to the second embodiment, in the seventh embodiment, a downstream end section 30*a* of a stationary core 30 and a downstream end section 14*a* of the second magnetic portion 14, which are surrounded by the coil 40, form a stationary portion 50. A part of the downstream end section 14*a*, which is other than the base wall 501 of the annular groove 500, and a part of the end section 30*a*, which is covered by the part of the downstream end section 14*a* other than the base wall 501 of the annular groove 500, cooperatively form a main portion 50*a*. Furthermore, a part of the end section 14*a*, which forms the base wall 501, and a part of the end section 30*a*, which is surrounded by the base wall 501 and the non-magnetic portion 13, cooperatively form a reduced size portion 50*b*.

Furthermore, with reference to FIG. 16, in the seventh embodiment, a cross-sectional area Sa of the main portion 50*a*, a cross-sectional area Sb (Sb1, Sb2) of the reduced size portion 50*b*, an axial length Lf of the reduced size portion 50*b*, an axial length La of the coil 40 and an axial distance Lc between a downstream end surface 40*c* of the coil 40 and a downstream end surface 50*c* of the stationary portion 50 are the same as those of the second embodiment. Here, the cross-sectional area Sb1 is measured in a plane that extends perpendicular to an axis O through the part of the end section 14*a*, which forms the base wall 501. The cross-sectional area Sb2 is measured in a plane that extends perpendicular to the axis O through the part of the end section 30*a*, which is covered by the non-magnetic portion 13. It should be noted that as long as 0.2≦Sb/Sa≦0.9 is satisfied, the cross-sectional area Sb of the reduced size portion 50*b* can be selected such that the cross-sectional area Sb1 and the cross-sectional area Sb2 are different from each other.

Additional advantages and modifications will readily occur to those skilled in the art. The invention in its broader terms is therefore, not limited to the specific details, representative apparatus, and illustrative examples shown and described.

What is claimed is:

1. A fuel injection device comprising:

a cylindrical member, which includes a first magnetic portion, a magnetic shield portion and a second magnetic portion arranged in this order from a downstream end of the cylindrical member toward an upstream end of the cylindrical member;

a valve body, which is held by the first magnetic portion of the cylindrical member and includes at least one fuel injection hole and a vale seat arranged on an upstream side of the injection hole;

a valve member, which is reciprocably received in the cylindrical member and includes an abutting portion, wherein the abutting portion is seatable on the valve seat to close the injection hole and is also liftable from the valve seat to release the injection hole;

a movable core, which is arranged on an upstream side of the valve member and is reciprocable together with the valve member;

a stationary core, which is arranged on an upstream side of the movable core and is opposed to the movable core in the cylindrical member;

an urging means for urging the valve member against the valve seat; and a coil, which is arranged radially outward of the cylindrical member to generate a magnetic force for attracting the movable core toward the stationary core upon energization of the coil, wherein the cylindrical member, the stationary core and the coil are sized to satisfy the following conditions: 5 mm≦La≦10 mm, 0 mm≦Lb≦1.0 mm, Lb≦Lc, and 0.5≦Ld/La≦1.5, wherein La is an axial length of the coil, Lb is an axial distance between a downstream end surface of the coil and a downstream end surface of the magnetic shield portion, Lc is an axial distance between the downstream end surface of the coil and a downstream end surface of the stationary core, and Ld is an axial length of the magnetic shield portion.

2. A fuel injection device according to claim 1, wherein the stationary core is shaped as a cylindrical body and is sized to satisfy the following conditions: 0.5 mm≦Le≦2.0 mm, and 0 mm≦Lc≦1.0 mm, wherein Le is a wall thickness of the stationary core.

3. A fuel injection device comprising:

a body, which includes at least one fuel injection hole and a valve seat arranged on an upstream side of the injection hole;

a cylindrical stationary portion, which exhibits magnetism and is secured to the body, wherein the stationary portion includes a main portion and a reduced size portion, which are arranged in an axial direction of the stationary portion, wherein a cross-sectional area of the reduced size portion measured in a plane perpendicular to an axis of the cylindrical stationary portion smaller than a cross sectional area of the main portion measured in a plane perpendicular to the axis of the cylindrical stationary portion;

a valve member, which is reciprocably received in the body and includes an abutting portion, wherein the abutting portion is seatable on the valve seat to close the injection hole and is also liftable from the valve seat to release the injection hole;

a movable portion, which is arranged on a downstream side of the stationary portion and also on an upstream side of the valve member and is reciprocable together with the valve member;

an urging means for urging the valve member against the valve seat; and a coil, which is coaxial with the cylindrical stationary portion and is arranged radially outward of the cylindrical stationary portion to generate a magnetic force for attracting the movable portion toward the cylindrical stationary portion upon energization of the coil, wherein:

the cylindrical stationary portion is sized to satisfy the following condition: $0.2 \leqq Sb/Sa \leqq 0.9$, wherein Sa is a cross-sectional area of the main portion, and Sb is a cross-sectional area of the reduced size portion; and the cylindrical stationary portion and the coil are sized to satisfy the following condition: $0.1 \leqq (Lf+Lc)/La \leqq 1.0$, wherein La is an axial length of the coil, Lf is an axial length of the reduced size portion, and Lc is an axial distance between a downstream end surface of the coil and a downstream end surface of the cylindrical stationary portion.

4. A fuel injection device according to claim 3, wherein the coil is sized to satisfy the following condition: $4\ mm \leqq La \leqq 12\ mm$.

5. A fuel injection device according to claim 3, wherein the reduced size portion is sized to satisfy the following condition: $11\ mm^2 \leqq Sb \leqq 28\ mm^2$.

6. A fuel injection device according to claim 3, comprising:

a cylindrical member, which includes a first magnetic portion, a magnetic shield portion and a second magnetic portion arranged in this order from a downstream end of the cylindrical member toward an upstream end of the cylindrical member; and a cylindrical stationary core, which is received in and is engaged with the magnetic shield portion and the second magnetic portion, wherein the stationary core exhibits magnetism, and the cylindrical stationary portion includes the second magnetic portion and the cylindrical stationary core.

* * * * *